US005211346A

United States Patent [19]

Brouwer

[11] Patent Number: 5,211,346

[45] Date of Patent: May 18, 1993

[54] AUTOMATIC WINDING UNIT

[75] Inventor: Charles W. Brouwer, Greensboro, N.C.

[73] Assignee: John Brown Inc., West Warwick, R.I.

[21] Appl. No.: 186,471

[22] Filed: Apr. 26, 1988

[51] Int. Cl.[5] ..... B65H 54/02; B65H 54/44; B65H 67/04

[52] U.S. Cl. ..... 242/18 R; 242/35.50 A; 242/46.4

[58] Field of Search ..... 242/18 R, 35.5 A, 35.5 R, 242/25 R

[56] References Cited

U.S. PATENT DOCUMENTS

| | | | |
|---|---|---|---|
| 3,375,989 | 4/1968 | League | 242/18 R |
| 3,762,661 | 10/1973 | Lucke | 242/18 R |
| 3,791,126 | 2/1974 | Kose et al. | 242/35.5 A |
| 3,820,730 | 6/1974 | Endo et al. | 242/35.5 A X |
| 3,908,918 | 9/1975 | Bergstrom | 242/18 R |
| 3,915,398 | 10/1975 | Corl | 242/35.5 A |
| 4,007,882 | 2/1977 | Isoard | 242/18 R |
| 4,023,741 | 5/1977 | Schar | 242/18 R |
| 4,052,017 | 10/1977 | Schar | 242/35.5 A |
| 4,069,983 | 1/1978 | Muramatsu et al. | 242/35.5 A |
| 4,340,187 | 7/1982 | Schippers et al. | 242/35.5 A |
| 4,437,617 | 3/1984 | Cardein | 242/35.5 A |

OTHER PUBLICATIONS

Decker et al., Def: Pub. of Ser. No. 75,510, filed Sep. 25, 1970, Def. Pub. No. T896,049.

*Primary Examiner*—Stanley N. Gilreath
*Attorney, Agent, or Firm*—Breiner & Breiner

[57] ABSTRACT

An automatic strand winding unit having a plurality of stations each comprising a strand supply such as glass roving, guide/traverse means, a horizontally positioned spindle for taking up strand material and automation for servicing the winding unit is described. The winding unit, including the automation, is programmed whereby, inter alia, the automation moves into a station having a full spindle, cuts the strand between the strand supply and the horizontally positioned full spindle and, while retaining the strand end from the strand supply, doffs the full spindle by pivoting the spindle to a substantially vertical or down position, and thereafter engages the strand end with a horizontally positioned empty spindle and restarts the winding operation. In a preferred embodiment the automatic winding unit is for winding glass roving using an improved coreless, expandable spindle having an automatic strand engaging and releasing mechanism.

5 Claims, 4 Drawing Sheets

AUTOMATIC WINDING UNIT

FIELD OF INVENTION

This invention is directed to improved strand winding units. More particularly, the invention relates to a strand winding unit which can be used in combination with automation for servicing the winding unit. The winding unit, including the automation, is programmed to, inter alia, automatically engage and cut a strand between the strand supply and a horizontally positioned spindle when a spindle is filled; retain the cut end of the supply while the full spindle is doffed by pivoting the spindle to a substantially vertical or down position; return the empty spindle to the horizontal, and thereafter rethread the empty spindle with the retained strand end and restart the winding. The invention includes an improved coreless spindle.

BACKGROUND OF INVENTION AND PRIOR ART

Conventional winding units for winding strand materials, such as glass roving and the like, have a plurality of stations comprising a roving supply, guide/traverse means, and a spindle for taking up the strand material. Normally such units are maintained by a skilled operator who watches for filled spindles. When a filled spindle occurs, the machine stops. The operator then removes the filled package and then restarts the winding of the supply on an empty spindle. The winding unit can be closed down for periodic removal of the filled packages from each of the stations of the unit, followed by restarting of the winding operation. As a result of the mode of operation, the winding is more labor intensive than desired, and/or the winding units are not efficiently employed.

Automatic winding units have been described in the prior art. One example of an automatic unit utilizes turret-type spindles where the continuous winding switches from one spindle to another while retaining the strand end. The turret-type units are not intended for a discontinuous winding operation. Other automated units have been described wherein during the time when a full package from a spindle is doffed and winding restarted, the strand material is wasted. Moreover, spinning units such as described in Bell and Niederer, U.S. Pat. No. 3,398,521 patented Aug. 27, 1968, which is assigned to the predecessor of the assignee of the present application, are known wherein a yarn end is severed and then a bobbin rethreaded with the retained yarn end. In the described units the donning, doffing, and rethreading operation is relatively complex and not suitable for use in a winding unit.

Accordingly, there is a need for automatic winding units capable of servicing a discontinuous winding operation suitable for, inter alia, taking up glass roving wherein the speed and tension on the strand material must be maintained substantially uniform throughout winding, including during the automatic doffing of roving packages from filled spindles, rethreading, and restarting which provides a uniform product and is relatively simple in operation.

SUMMARY OF INVENTION

The present invention provides an automatic winding unit for the discontinuous process for the winding of strand material, such as glass roving, comprising a plurality of winding stations, the winding head of each winding station being positioned on a subplate rotatable around a pivot point on a support. Each station has a strand supply, a traverse roller-bail assembly, and a horizontally positioned spindle assembly. Drive means, such as an electric motor for driving the spindle and brake means for stopping the spindle are constructed and arranged with the spindle. The winding of the strand material onto the spindle is controlled by the traverse roller-bail assembly positioned adjacent to the spindle on the subplate which includes guide/traverse means and speed control means for maintaining relatively constant strand winding speed. The spindle assembly and roller-bail assembly are movable with respect to each other between a "frame-in" or "frame-out" position by means of an air cylinder pivotably connected to the spindle assembly.

When actuator means such as an air cylinder is activated, the subplate carrying the entire winding unit rotates around a pivot point on the support so that the spindle faces down. A full package on the spindle is released from the spindle in the spindle-down position. The unit is then rotated back to the horizontal operating position and winding restarted.

The spindle of the spindle assembly can be any of the conventional spindles. However, in a particularly preferred embodiment a coreless spindle such as an air-actuated spindle, commercially available from the Tidland Corporation, Oak Ridge, New Jersey, is modified to include air-actuated strand engaging and holding means. According to the modification, an air gland is added to the rear of the Tidland spindle. Appropriate holes are drilled into the spindle so that the gland is connected to the elastomeric bladder of the spindle. An air-actuated strand clamp is added to the front of the spindle. The clamp is mechanically biased open, for example with a mechanical spring. When in the open position, the clamp is capable of receiving a strand material. When air is supplied to the spindle through the air gland, the air pressure releases the mechanical spring, automatically closing the clamp to engage a strand material.

The traverse roller-bail assembly of the invention comprises a strand guide and traverse means and means for maintaining a constant winding speed. The strand speed is controlled by a suitable feedback control. In one suitable design, pulses are generated by the feedback device which are fed to a preset counter capable of producing a contact closure upon reaching preset which indicates the total length of the strand which has been wound. The roller-bail pressure on the spindle can be regulated and controlled by the same air cylinder which moves the spindle assembly and roller-bail assembly between the "frame-in" and "frame-out" positions.

The automatic winding unit can also include automation which is positioned in front of one winding station or positioned to travel in front of a plurality of winding stations, for example, on a track. The automation includes an arm constructed and arranged to move between the traverse roller-bail assembly and the spindle assembly. The arm at its extended end includes means for simultaneously cutting and retaining the strand end extending from the supply. Once the strand is cut and retained, the arm once again moves out until a full package is doffed and the spindle assembly is returned to its winding position, at which time the automation arm positions the strand end onto an empty spindle.

In a preferred operation, the unit is programmed whereby when a full package is sensed on the spindle, for example by counting the length of the strand, the unit will automatically brake to stop the spindle. The traverse roller-bail assembly and spindle assembly assume a frame-out position at which position the filled spindle is positioned away from the traverse roller-bail assembly. The automation from a position in front of the assembly extends an arm between the traverse roller-bail assembly and the full package for engaging and cutting the strand. The arm retains the supply end of the cut strand material and, while the strand is being retained, the automation arm is withdrawn. The subplate is then pivoted to a down position, the package released from the spindle, and afterwards the subplate is again pivoted to its horizontal winding position. The arm from the automation then again enters and attaches the retained strand end onto the spindle and withdraws. The winding operation again starts up.

The entire assembly is compact and, because of the horizontal positioning of the spindle on a subplate, provides a convenient doffing and restarting means. Additionally, the ability to control the roller-bail pressure on the spindle with the air cylinder for moving the spindle and roller-bail assemblies between a frame-in and frame-out position provides an accurate bail pressure control resulting in a tight, compact roving package. Since the roving winding is a discontinuous process, the unit is particularly suitable for winding glass roving.

Having described the invention in general terms, a presently preferred embodiment will be described with reference to the drawing.

THE DRAWING AND PRESENTLY PREFERRED EMBODIMENT

Figure 8:
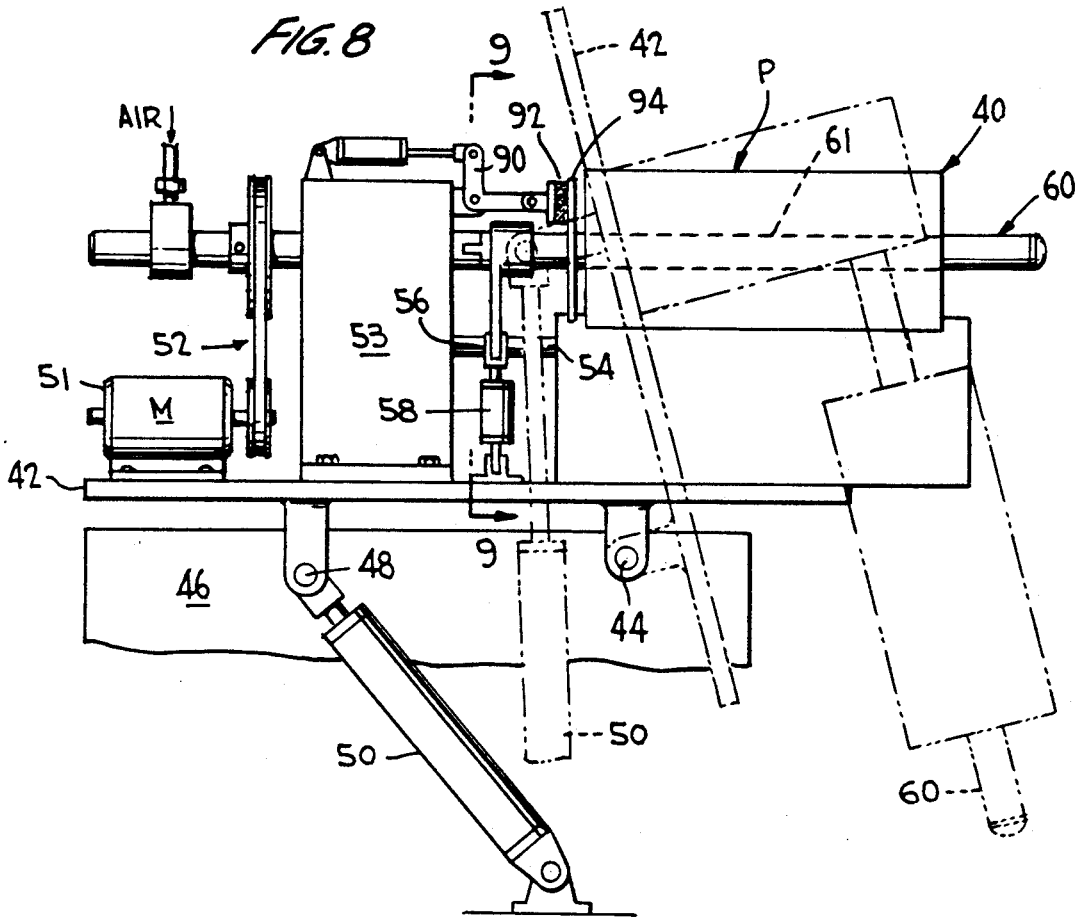
FIG. 8 is a detailed, sectional view of the package doffing mechanism showing the pivoting of the subplate and assembly to the down-position in broken lines.

Referring to the drawing, the winding unit of the present invention comprises as essential components a supply of strand material "S" for winding, a traverse roller-bail assembly 20, a spindle assembly 40, and automation 80; The traverse roller-bail assembly 20 and spindle assembly 40 are mounted on subplate 42 which is pivotally movable on support 46 as shown in FIG. 8. Additionally, the invention includes an improved spindle 60 as part of the spindle assembly 40. For convenience, these separate components which operate in combination according to the invention will be first described separately.

The Strand Supply

The strand material for rewinding can, as a practical matter, be derived from any source including package material for rewinding, roving filaments, and the like. The winding unit of the presently described invention is particularly suitable for winding glass strands where glass filaments R are drawn from a plurality of packages 10 to provide strand S of the desired denier. In the present winding unit, the winding process is discontinuous with the tension and speed of the strand being carefully controlled, including through control of the roller-bail pressure to provide a uniform product.

The Traverse Roller-Bail Assembly

Figure 1:
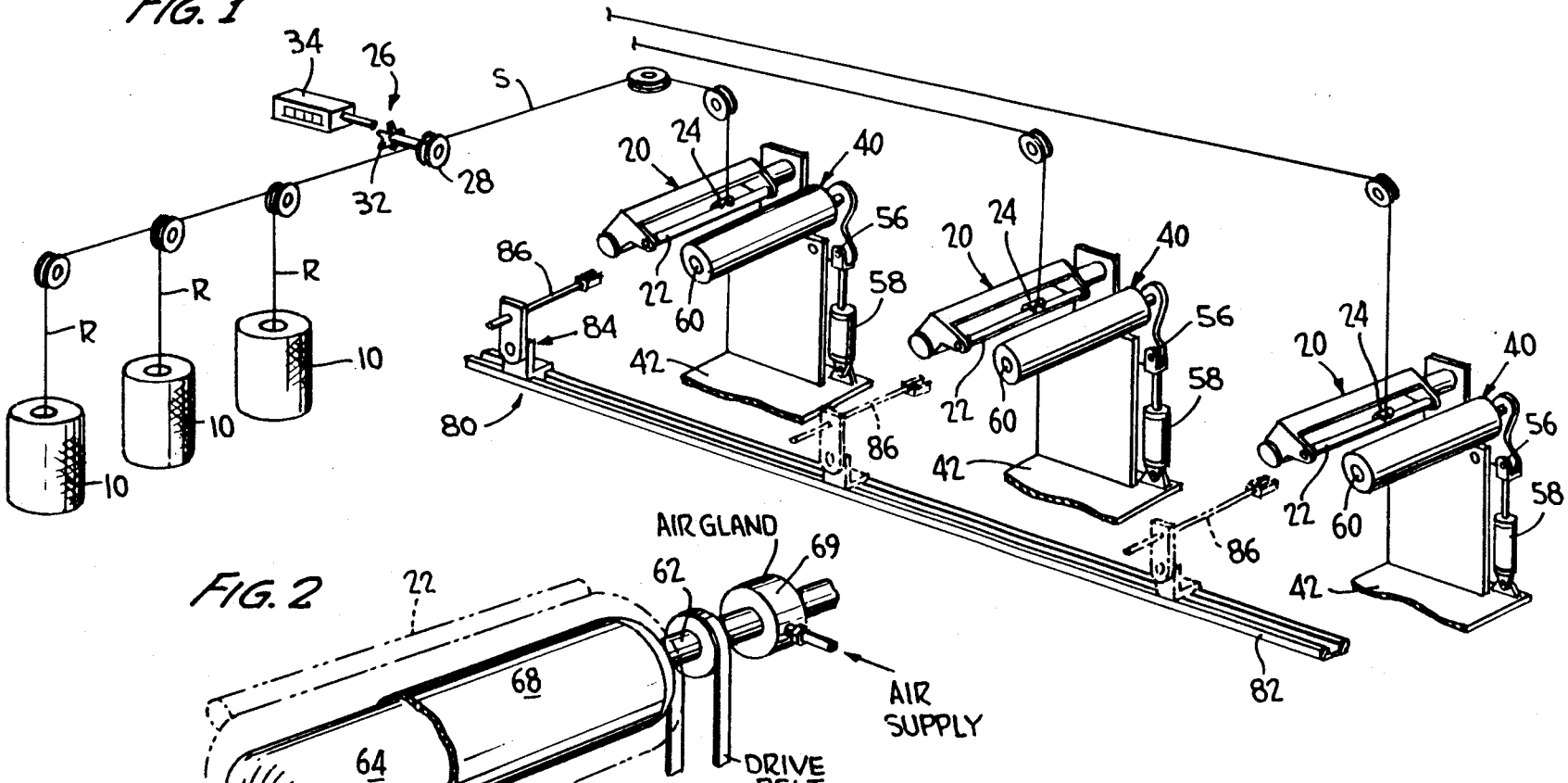
FIG. 1 is a schematic view of a plurality of winding units, partially broken away, constructed according to the invention showing a roving supply as the strand material to be wound.
Figure 5:
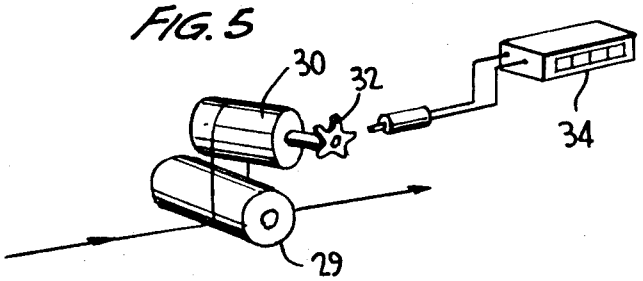
FIG. 5 illustrates a second embodiment of a suitable speed control and package sensing mechanism.

The traverse roller-bail assembly 20 comprising a roller 22 and traverse guide means 24 is mounted on subplate 42 adjacent to spindle assembly 40. Assembly 20 is of the type conventionally employed in a strand winding unit. The assembly is associated with a tac feedback 26 for achieving a constant strand speed and means for achieving a constant strand tension. Tac feedback 26 can be of any suitable type such as a single roller 28 as shown in FIG. 1, or a unit comprising a plurality of rotating rolls as shown in FIG. 5 interposed between the roving supply 10 and the traverse roller-bail assembly 20. In the embodiment shown in FIG. 5, one of the rolls is interconnected to magnetic brake, means to provide an adjustably predetermined constant tension to the strand. Moreover, the pair of rollers are skewed to enable wrapping of the pair of rollers 29, 30 several times, with this method ensuring that virtually no strand slippage will occur. A toothed wheel 32 is affixed to roller 28 or 30 in proximity to a sensor placed so as to generate impulses to preset counter 34. The pulses fed to the preset counter produce a contact closure upon reaching preset, indicating the total length of roving which has been passed over roller 28 or rollers 29, 30. This device controls the speed and tension of the strand material.

Figure 9:
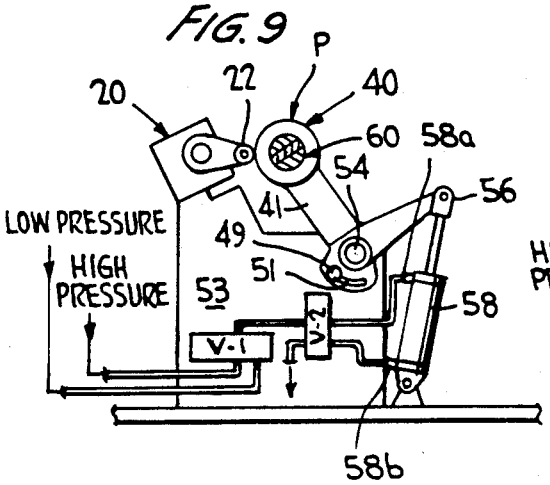
FIGS. 9 and 10 illustrate the frame-in and frame-out positioning of the spindle assembly with respect to the roller-bail assembly taken generally along line 9—9 of FIG. 8.
Figure 10:
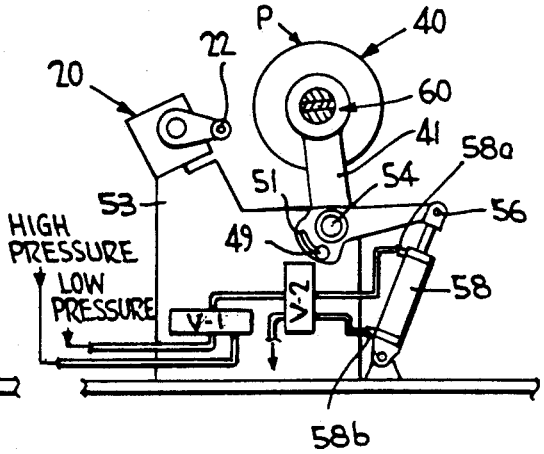
Figure 11A:
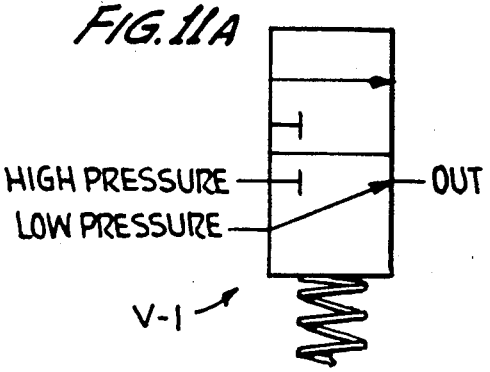
FIGS. 11A and 11B illustrate, schematically, a first valve V-1 used in regulating air to cylinder 58.
Figure 11B:
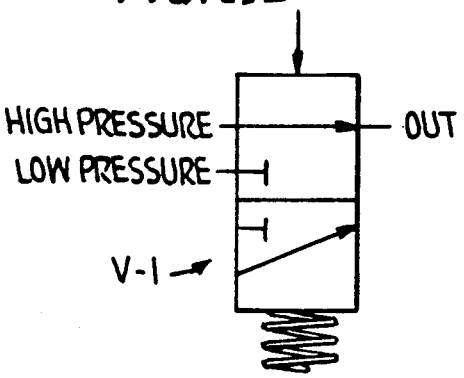
Figure 12:
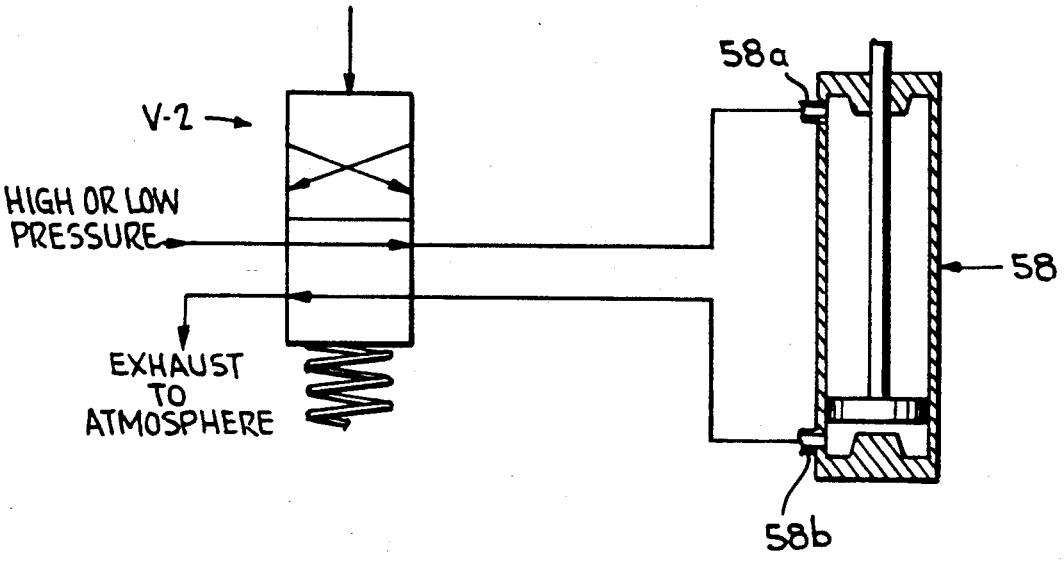
FIG. 12 illustrates, schematically, a second valve V-2 used in regulating air to cylinder 58.

The winding pressure on the roller-bail assembly is adjustably controlled by air cylinder 58. As best shown in FIGS. 9 and 10, the movement of the spindle assembly 40 relative to the traverse roller-bail 20 is controlled by fastener 49 in a crescent-shaped slot 51. The position of fastener 49 in slot 51 modifies the force applied. Air pressure to cylinder 58 is controlled by valves V-1 and V-2, schematically shown in FIGS. 11A, 11B, and 12. A high-pressure source is fed by lines **58*a* and 58*b* to cylinder 58 during the frame-in and frame-out motion of the spindle frame 41. Low-pressure air is fed by line 58*b* to cylinder 58** during winding to control the winding head pressure on the package being wound. This mechanism is fully described in commonly assigned Brouwer and Cowan application entitled "Winding Unit With Air-Controlled Winding Head Pressure." Ser. No. 186,292 filed Apr. 26, 1988. The disclosure of this application is incorporated herein by reference.

The Spindle Assembly

The spindle assembly 40, as best shown in FIG. 8, is mounted on subplate 42 which is pivotally secured at pivot point 44 to support 46. Subplate 42 is also pivotally attached at pivot point 48 to an air cylinder 50.

As best shown in FIGS. 8–10, the spindle assembly comprises electric drive motor 51 mounted on subplate 42 which drives spindle 60 through pulley and belt arrangement 52. The spindle assembly is horizontally disposed with respect to subplate 42 and support 46.

Also as shown in FIGS. 8–10, spindle assembly 40 is pivotally mounted at pivot point 54 to housing 53 which, inter alia, supports hollow spindle shaft 61 and at pivot point 56 to an air cylinder 58 which, in turn, is mounted on subplate 42. When air cylinder 58 is in the extended position, spindle 60 is in frame-in winding relation to rollerbail assembly 20, as shown in FIG. 9, and, when in the retracted position, is in the frame-out position, as shown in FIG. 10, necessary for the doffing movement when cylinder 50 is extended to pivot subplate 42 around pivot point 44 to place spindle 60 in a substantially vertical or down doffing position.

The Automation

Figure 6:
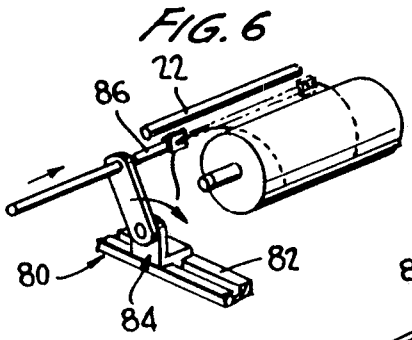
FIGS. 6 and 7 illustrate the strand engaging movement of the automation.
Figure 7:
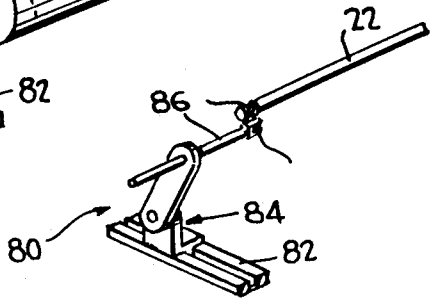

The plurality of stations of the automatic winding unit are serviced by automation assembly 80. The assembly, as shown in FIGS. 1, 6 and 7, comprises a track 82 running in front of the plurality of winding stations and automation 84. Automation 84 includes an arm 86 which moves between the roller-bail assembly 20 and the spindle 60 when the spindle is in the frame-out position to engage a strand, cut the strand, and retain the supply end of the strand. The arm with the retained strand then moves out until the doffing of the full package is completed. Thereafter, the arm again moves in with the retained strand end for attachment to the spindle.

The Improved Spindle

Figure 2:
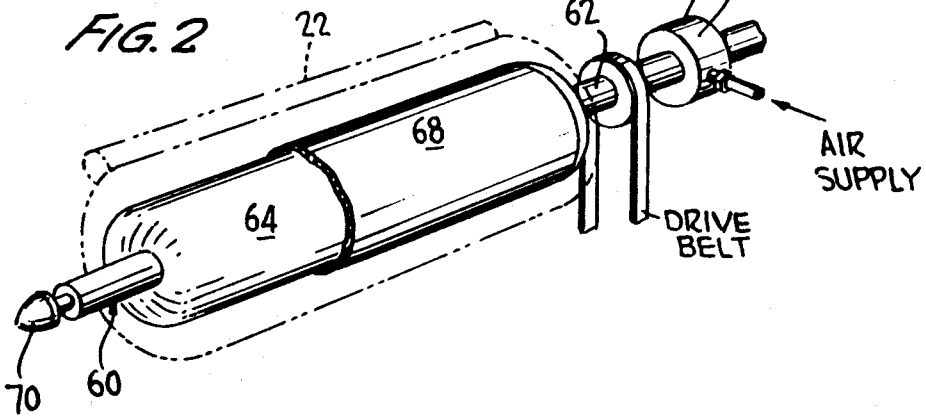
FIG. 2 is an enlarged view of the preferred spindle arrangement showing part of the traverse roller-bail assembly in broken lines.
Figure 3:
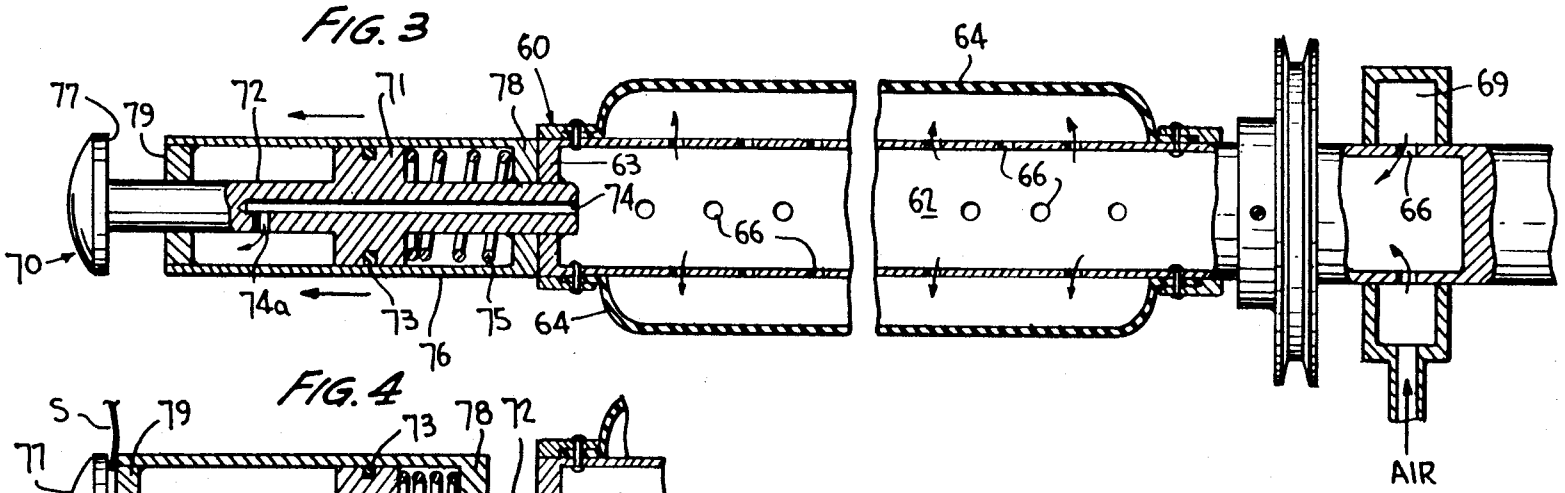
FIG. 3 is a cross-sectional view of the preferred spindle arrangement with the bladder only beginning to inflate and with the strand clamping mechanism being held in the open position by a spring means.
Figure 4:
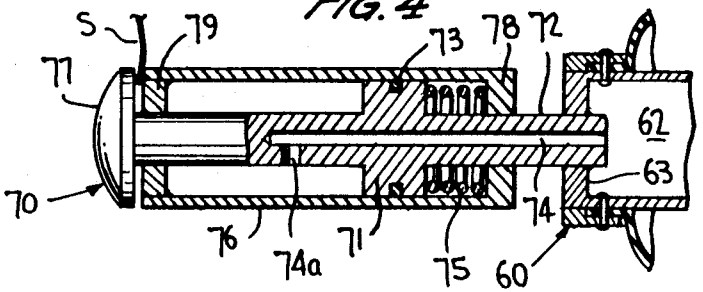
FIG. 4 is a partial view similar to the view of FIG. 3 but with the spindle bladder inflated and the strand clamping mechanism being air actuated to the closed position retaining a strand end.

Any conventional spindle arrangement whether it be coreless or one which uses a tube for accepting the strand material can be used according to this invention. However, a coreless spindle having an expandable elastomeric bladder for retaining the strand package modified to include a strand clamping mechanism is the preferred spindle. The modified spindle arrangement of this invention is best shown in FIGS. 2–4. Referring to FIGS. 2–4, the expandable spindle 60 includes a hollow metal core 62 having a plurality of openings 66 surrounded by an elastomeric bladder 64. Air supplied under a pressure is fed into the interior of core 62 from air gland 69 where it passes through opening 66 to expand the elastomeric bladder 64. The strand material is preferably wound directly upon the bladder 64 or, alternatively, a tube, not shown, can be fitted onto the bladder. In the disclosed modification, a clamping mechanism extension 70 is added to the end of metal core 62. The extension includes a concentric member 72 fitted adjacent to end wall 63 of core 62 having an annular air passage 74 therethrough. Member 72 has an enlarged section 71. Concentrically arranged around member 72 and mated to enlarged section 71 to form a piston is cylinder 76 having a rear end 78 and a front end 79. Piston 71 is circumscribed by O-ring 73.

A spring 75 is positioned between piston 71 and end wall 78. When no air pressure is being applied to cylinder 62, the spring 75 is extended, causing the clamping end 77 of concentric member 72 to be biased in an open position as shown in FIG. 3. However, when air pressure is applied interior of member 62, it enters opening 74, exits opening **74*a* reacting against end wall 79 and piston 71 contracting spring 75, causing the clamping member 77 to come into engagement with front wall 79** of the clamping mechanism.

Accordingly, when no air pressure is applied to the bladder as in a packaged doffing position, the clamp is open. However, when the air pressure is applied to the center expanding the elastomeric bladder 64, the clamping mechanism will be closed, contacting and retaining a strand material.

Operation of Winding Unit

The winding unit is threaded and winding initiated the same as with a conventional winding unit. After startup, the unit is automatically programmed so that the length of strand passing over roller 28, or rollers 29 and 30 is measured by counter 34. When a predetermined length of strand material has been measured and wound onto package P, counter 34 outputs a command signal to simultaneously disconnect the motor and actuate brake actuator 90 to set brake pads 92 against spindle plate 94 constructed and arranged on spindle 60, stopping the rotation of the spindle. When the spindle is fully stopped, the brake is released and a sequence of actions is commenced whereby spindle 60 carrying full strand package P is moved from the frame-in operating position as shown in FIG. 9, to the frame-out doffing position as shown in FIG. 10 by actuation of air cylinder 58. When in the frame-out position, automation 84 will be on track 82 positioned in front of the winding station to be serviced in a first position as shown in FIG. 6 where arm 86 will enter between the traverse roller-bail assembly 20 and the spindle assembly 40 to engage, cut and retain the supply end of strand 18, and then withdraw.

After arm 86 has withdrawn, air cylinder 50 will be actuated as shown in FIG. 8 to pivot subplate 42 around pivot point 44 carrying the spindle assembly into a substantially vertical or down position. When in this position, the air flow to spindle 60 will be terminated, causing bladder 64 to deflate, and also removing pressure on piston 71 whereby spring 75 opens clamp 77, releasing strand S. Full package P is released from spindle 60. Once package P is released, air cylinder 50 is contracted, again bringing spindle assembly 40 into a horizontal position. When in the horizontal position, air cylinder 58 will contract, bringing the spindle into operating relation to roller-bail assembly 20. When in this position, automation arm 86 will shift to a second position as shown in FIG. 7, laying retained strand S into open clamp 77 as shown in FIG. 3.

Air pressure will be again applied to cylinder 60 which will inflate bladder 64 and simultaneously move clamp 77 into the closed position as shown in FIG. 4 so as to retain strand S. Automation arm 86 will then release strand S and be free to travel to service other stations. Counter 34 has been reset. Winding of a new package will commence. Low-pressure air is applied to air cylinder 58 through line **58*b* to control roller-bail pressure on spindle 60**.

As is apparent, the various components of the winding unit are programmed to perform specific functions at the various sequences of operation. After one function is accomplished, a particular component will remain in a given position until a second command is given, as fully defined in Table 1.

As shown in Table 1, the spindle bladder remains inflated for all of the sequences of operation except at the time a full package is doffed, the spindle is returned to horizontal, and the supply strand end is engaged with a fresh spindle. The spindle frame is in the frame-in position during winding and during the final positioning at restart of winding. Air roller-bail pressure is on only during the winding operation. The motor is off for all sequences except while winding. The brake is off for all sequences except when a full package is sensed and the full package on the spindle is brought to a complete stop. The counter is counting only during winding. However, the counter is reset at the same time that the package is doffed. The tilt cylinder is in the horizontal position throughout the programmed operation except during the package down and doffing sequences. The robot arm is at rest during the winding, when a full package is sensed, during the initial position for package removal, and during the period of restart of winding. In the other sequences of operation, the robot arm is gathering a strand, retracting with the gathered strand, holding the strand during doffing, positioning the supply end of the strand on the spindle after doffing, clamping the strand on the spindle, and retracting after the strand is released. These sequence of functions provide for the automatic winding of a strand material. Table 1 is as follows:

ated. Moreover, a winding station need not be serviced by automation. A winding station, whether utilized individually or as one of a plurality, can be manually operated. As will also be apparent, it is possible to program the winding unit with the automation for various sequences of events. Thus, the automation can be programmed for servicing full spindles, and with modification servicing a spindle where a supply strand is broken, or both; or for different events wherein after a first event has been accomplished the automation leads to a subsequent event. Such modifications being within the ability of one skilled in the art form a part of the present invention and are embraced by the appended claims.

It is claimed:

1. A strand winding unit comprising a support, a subplate rotatably positioned on said support, a traverse roller-bail assembly comprising a traverse guide and roller, a horizontally positioned spindle assembly including spindle means, and means for driving said spindle means for taking up a strand material; said traverse roller-bail assembly, spindle assembly, and drive means being positioned on said subplate, and means for rotating said subplate on said support whereby said spindle means is moved from its horizontal position to a substantially vertical or down position for removing a strand package from said spindle means.

TABLE 1

| | (1) Winding | (2) Full Package | (3) Initial Position for Package Removal | (4) Cut and Clamp "S" | (5) Retract Clamped "S" End | (6) Package Down | (7) Doffing Package |
|---|---|---|---|---|---|---|---|
| Spindle Bladder | Inflated | Inflated | Inflated | Inflated | Inflated | Inflated | Deflated |
| Frame/Air Cylinder | Frame-In Air Roller-Bail Pressure ON | No Air | Extend Cylinder | Frame-Out | Frame-Out | Frame-Out | Frame-Out |
| Motor | ON | Disconnect | OFF | OFF | OFF | OFF | OFF |
| Brake | OFF | ON | OFF | OFF | OFF | OFF | OFF |
| Counter | Counting | Not Counting | Not Counting | Not Counting | Not Counting | Not Counting | Reset |
| Tilt Cylinder | Horizontal | Horizontal | Horizontal | Horizontal | Horizontal | Vertical | Vertical |
| Robot Arm | At Rest | At Rest | At Rest | Extend Clamp Arm/ Gather "S" and Cut Package End | Retracting Clamp Arm w/Clamped Supply "S" | Retracted Holding "S" | Retracted Holding "S" |

| | (8) Spindle Back to Horizontal | (9) Supply "S" to Fresh Spindle | (10) Strand Clamping | (11) Initial Position Readying For Restart | (12) Final Position for Restart | (13) Restart Winding |
|---|---|---|---|---|---|---|
| Spindle Bladder | Deflated | Deflated | Inflated | Inflated | Inflated | Inflated |
| Frame/Air Cylinder | Frame-Out | Frame-Out | Frame-Out | Frame-Out | Frame-In | Frame-In Air Roller-Bail Pressure ON |
| Motor | OFF | OFF | OFF | OFF | OFF | ON |
| Brake | OFF | OFF | OFF | OFF | OFF | OFF |
| Counter | Not Counting | Not Counting | Not Counting | Not Counting | Not Counting | Counting |
| Tilt Cylinder | Return to Horizontal | Horizontal | Horizontal | Horizontal | Horizontal | Horizontal |
| Robot Arm | Retracted Holding "S" | Positioning "S" on Spindle | Clamping "S" on Spindle | Retracting After Releasing "S" | At Rest | At Rest |

A unique feature of the strand winding unit of the present invention is in the ability to include in the winding unit means for communicating with automation after performing a function, such as presenting a strand package for doffing, commanding the automation to perform a subsequent act or multiplicity of acts such as strand package removal; preparing the winding unit for resumption of winding, and the like. In all known prior art automated winding operations, the winding unit has remained passive with the intelligence residing in the robot means. Accordingly, an important feature of the present invention is to provide a winding unit which can communicate with automation, such as a robot, and command the automation to carry out acts.

As will be apparent to one skilled in the art, various modifications can be made within the scope of the aforesaid description. For example, it is not necessary according to the invention to utilize a plurality of winding stations. A winding station can be individually oper-

2. The winding unit of claim 1 wherein said spindle assembly includes means for moving said spindle means into a winding and non-winding position with respect to said traverse roller-bail assembly.

3. The winding unit of claim 2 wherein said means for moving said spindle means into a winding and non-winding position is an air-actuated cylinder.

4. The winding unit of claim 3 wherein said air cylinder is constructed and arranged with said traverse roller-bail assembly to selectively control the pressure on said roller during a winding operation.

5. The winding unit of claim 1 wherein said means for rotating said subplate from a horizontal position to a vertical position is an air cylinder.

* * * * *